US005906526A

United States Patent [19]

Freeman

[11] Patent Number: 5,906,526

[45] Date of Patent: May 25, 1999

[54] INFLATABLE WATERCRAFT HAVING A STEERING SYSTEM

[76] Inventor: Thomas J. Freeman, 3709 Rockbridge Rd., Stone Mountain, Ga. 30083

[21] Appl. No.: 08/922,716

[22] Filed: Sep. 2, 1997

Related U.S. Application Data

[60] Provisional application No. 60/024,986, Sep. 30, 1996.

[51] Int. Cl.[6] ..... B63B 1/00

[52] U.S. Cl. ..... 441/66; 114/345; 114/144 R

[58] Field of Search ..... 441/65, 66; 114/353, 114/345, 346, 144 R, 156, 160

[56] References Cited

U.S. PATENT DOCUMENTS

| | | | |
|---|---|---|---|
| 1,360,105 | 11/1920 | Flisek | 114/160 |
| 3,403,578 | 10/1968 | Morse | 114/160 |
| 3,543,314 | 12/1970 | Tropf et al. | 114/169 |

FOREIGN PATENT DOCUMENTS

| | | | |
|---|---|---|---|
| 214761 | 10/1941 | Switzerland | 114/345 |

*Primary Examiner*—Ed L. Swinehart

[57] ABSTRACT

A method and apparatus for effectively steering/controlling a towable inflatable watercraft utilizing a pulley steer steering system. The present invention allows a person/persons the convenience of being able to effectively control the direction of an inflatable watercraft. Any inflatable watercraft which utilizes the pulley steer steering system will be able to travel back and forth across the wake of a towing watercraft in a manner comparable to that of a jet ski. The advantage of this invention being that those who can't afford a jet ski or who are no longer permitted to operate a jet ski (due to recent legal restrictions) can experience the same thrill of travelling/jumping across a wake as a jet ski provides. This effect can not be provided in existing inflatables without damage being inflicted on the craft. This invention incorporates the use of the pulley steer steering system, whereby; a rope is safely housed within a hose which protects the watercraft from damage from the rope. This invention known as the Jump-A-Wake will revolutionize water recreation.

1 Claim, 4 Drawing Sheets

INFLATABLE WATERCRAFT HAVING A STEERING SYSTEM

This application claims benefit of provisional application 60/024986 filed Sep. 30, 1996.

BACKGROUND OF THE INVENTION

This invention relates to an inflatable watercraft wherein the operator is able to steer the watercraft by using a pulley steer steering system. This watercraft (herein referred to as Jump-A-Wake) may be towed behind another watercraft. The Jump-A-Wake is a product designed to enhance water recreation.

Power/Jet driven watercrafts (jet skis) have become extremely popular over the past decade. People of all ages enjoy the thrill of riding something over water which they can control. Unfortunately, as the popularity of these watercrafts has grown, the amount of tragic accidents on the water has steadily increased. One of the main reasons the accident rate has soared is because jet skiers like to jump the wakes of motor boats (or other such watercrafts). This has led to disaster in many cases because jet skiers end up running into the back of the watercraft they are following. As a result most states require that jet ski riders be at least fourteen years of age and licensed to operate these types of watercrafts. Currently, there are many towable watercrafts being manufactured which resemble a jet ski in appearance. However, these towables do not come equipped with a real means of control. Thus, the riders of these towables find themselves at the mercy of the person at the helm of the towing watercraft. Riders of present day towables are not able to experience the thrill of travelling or jumping across the wake of the towing watercraft in a manner comparable to that of a jet ski. The modern day inflatable rider must try to lean to one side or the other in order to attempt to steer his/her watercraft.

BRIEF SUMMARY OF THE INVENTION

This invention is directed to an inflatable watercraft which may be steered/controlled by utilizing the pulley steer steering system. The object of this present invention is to provide a convenient means of steering an inflatable watercraft which is towed behind a boat (or watercraft of the like) in a manner which is comparable to that of a sit down jet ski, yet, much safer. The object of this present invention is to allow those who can't afford a jet ski or who are now unable to operate a jet ski (due to legal restrictions), the opportunity to experience the thrill of travelling/jumping across the wake of a boat on a sit down watercraft. This invention alleviates the problem of running into the back of the towing watercraft while still allowing the rider/riders to travel/jump the wake of the lead watercraft in an effective manner.

This invention comprises an inflatable watercraft which works in cojunction with a pulley steer steering system to accomplish the act of steering/controlling the inflatable watercraft. The inflatable watercraft is similar in size and structure to many infaltables currently manufactured and distributed. The pulley steer steering system is comprised of: 1.) A rope or cable (or the like). 2.) A heat resistant hose or pvc tube (or the like). 3.) A steering apparatus (ex. steering bar, steering wheel, or apparatus which accomplishes the same effect). 4.) A rudder system or ski system (which interacts with water to determine direction). The pulley steer steering system separates this invention from all other towable inflatables. By running the rope through the hose to the rudder or ski the pulley steer steering system eliminates the possibility of burning through or exploding the inflatable watercraft. Thus, when the Jump-A-Wake operator steers the watercraft in one direction or the other, the watercraft will respond in a way that is safe to both the operator and the watercraft itself.

DETAILED DESCRIPTION OF THE INVENTION

Broadly, the present invention comprises an inflatable watercraft containing a pulley steer steering system which allows a person/persons assistance in effectively controlling the watercraft. The watercraft itself may be of any shape, form, or size. At present, the watercraft will be shaped in a form very similar to that of a sit-down jet ski. The watercraft will not vary greatly in shape than many presently manufactured watercrafts. However, adding the pulley steer steering system to the watercraft will separate this invention from all other towable inflatables. The Jump-A-Wake revolutionizes the recreational activity of inflatable riding. Never before has an inflatable rider been able to travel back and forth across the wake of a towing watercraft in an effective manner. By incorporating the pulley steer steering system, the Jump-A-Wake changes the whole sport of inflatable riding. All components of my invention work together to enable the user/users of my invention to experience a ride very similar to that of a jet ski at a fraction of the cost. This product can do just about anything a jet ski can do behind a boat (except run into the back of it). The Jump-A-Wake rider experiences a thrill comparable to that of a waterskier or jet skier as he/she cuts across the wake of a boat. The key to this present invention is the pulley steer steering system. By placing the rope (cable or the like) inside of a hose (pvc tube or the like) the watercraft is protected from wear and tear which could cause the craft to lose air or explode. Whether this invention is made with a mini ski system or a rudder system, the fact that the rope/hose connects with either system is essential to the invention's effectiveness and individuality. Each of these aspects of the present invention are discussed further below.

Figure 1:
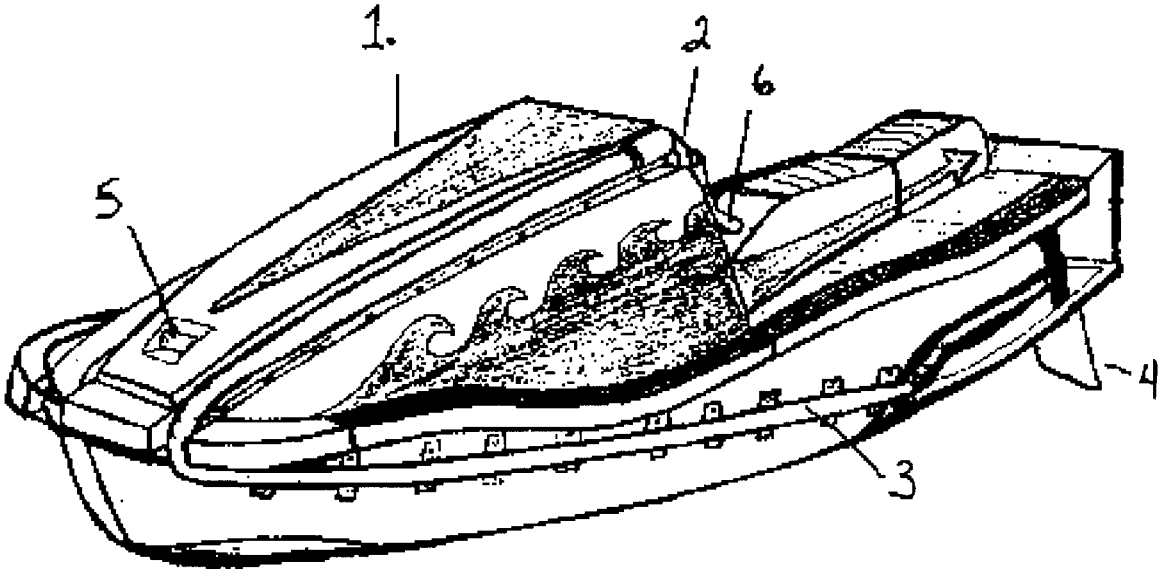
FIG. 1 is a perspective view of the Jump-A-Wake—the invention which enables an inflatable watercraft operator to steer/control his/her towable watercraft.

The inflatable watercraft 1 FIG. 1 is very similar to many inflatable watercrafts currently manufactured and distributed. The inflatable watercraft may be constructed of a wide variety of plastic, rubber, nylon, canvas or materials of like nature. The inflatable watercraft may be manufactured in many different size and shape variations. The inflatable watercraft will be made to be extremely durable with performance being a major consideration in it's construction. The inflatable watercraft may contain seating for one or more persons, or may be made in a lay down design. The inflatable watercraft will always contain one or more towing rope receptors 5 FIG. 1. The inflatable watercraft will always be adjoined to the pulley steer steering system utilizing a rope (or the like) 2 FIG. 1, FIG. 2 & FIG. 3 and hose (or the like) 3 FIG. 1, FIG. 2 & FIG. 3. The towing rope receptors 5 FIG. 1 may be strategically placed around the inflatable watercraft and may be constructed of plastic-like or metal-like materials. The towing rope receptors serve the function of joining the watercraft with the towing rope and assisting in maintaining the balance of the craft. The rope 2 FIG. 1, FIG. 2 & FIG. 3 may be constructed of high grade hemp (or the like), plastic (or the like), nylon (or the like), or metal (or the like). The rope will connect the steering mechanism 6 FIG. 2 to the directional device 4 FIG. 1, FIG. 3 & FIG. 4. The rope will be encased within and run through the hose 3 FIG. 1, FIG. 2 & FIG. 3. The hose 3 FIG. 1, FIG. 2 & FIG. 3 may be constructed of plastic (or the like), pvc (or the like), rubber (or the like), metal (or the like), or a combination of various materials similar to those stated herein. The hose 3 will house the rope 2. The hose will protect the watercraft from wear, tear, and friction which would be created by the rope if the rope was not separated from contact with the watercraft. The hose will be fabricated to be heat resistant and highly durable. The hose may be adjoined to the watercraft in a wide variety of ways. The hose is the single key ingredient to making the pulley steer steering system the most effective steering system to be provided to a towable inflatable watercraft.

Figure 2:
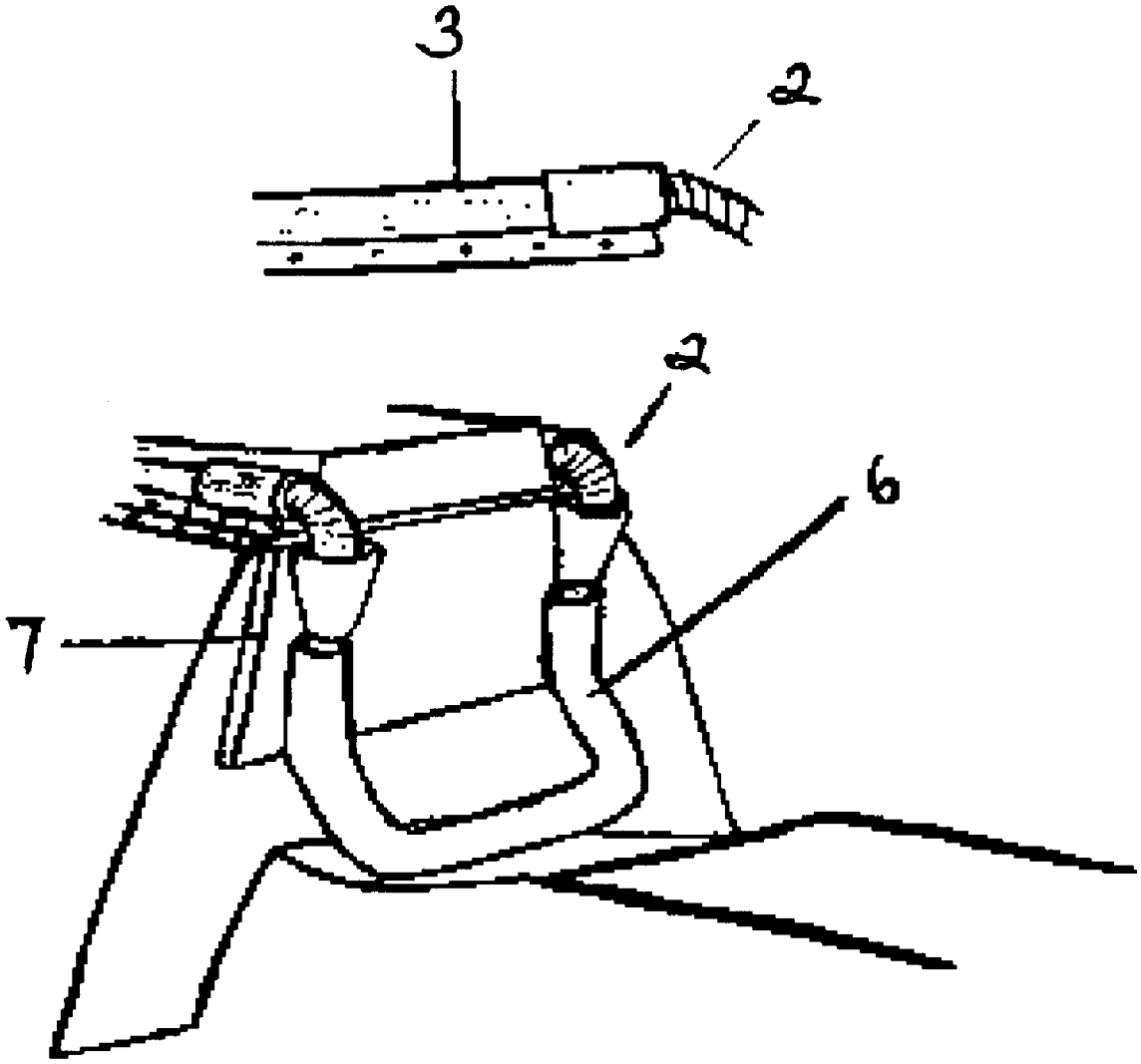
FIG. 2 illustrates two partial views of the basic components of the pulley steer steering system. These components work together in a manner which separates the present invention from all previously presented inflatable watercrafts.
Figure 3:
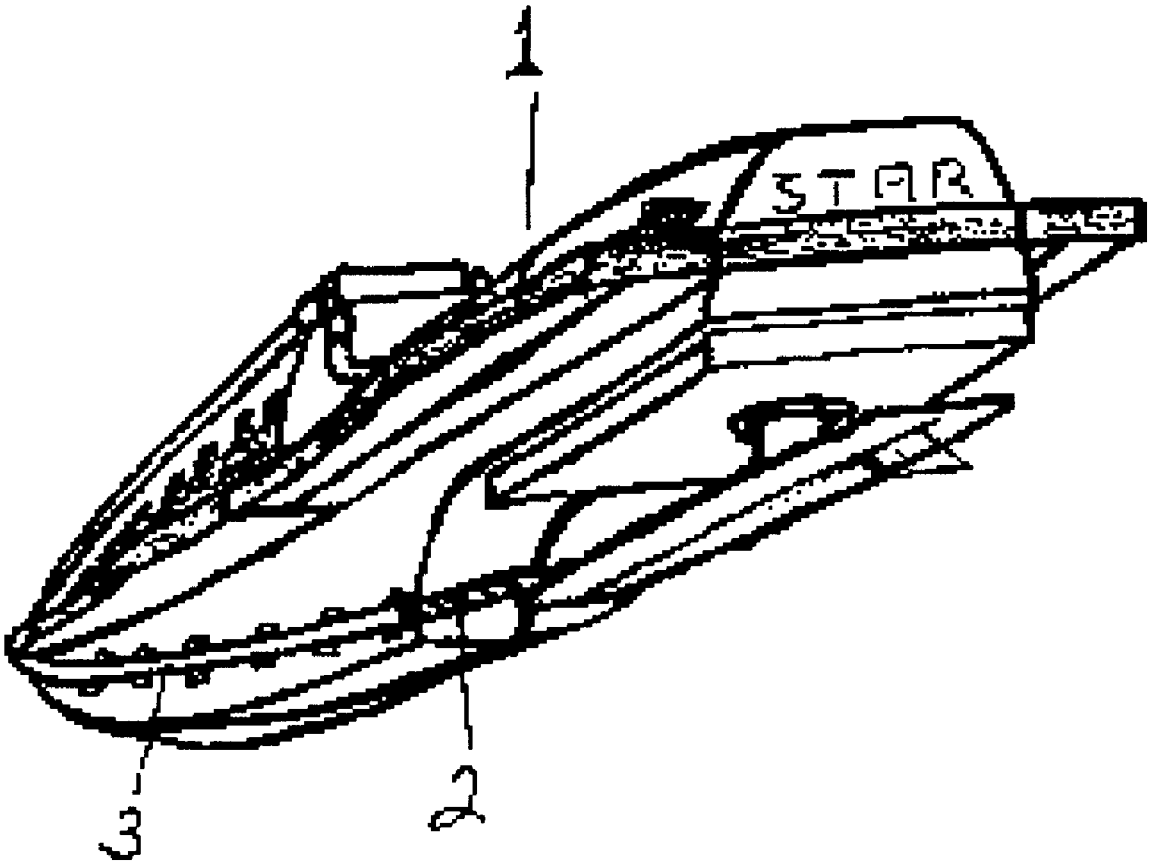
FIG. 3 shows an underside view of the pulley steer steering system utilizing a mini ski as a directional device.
Figure 4:
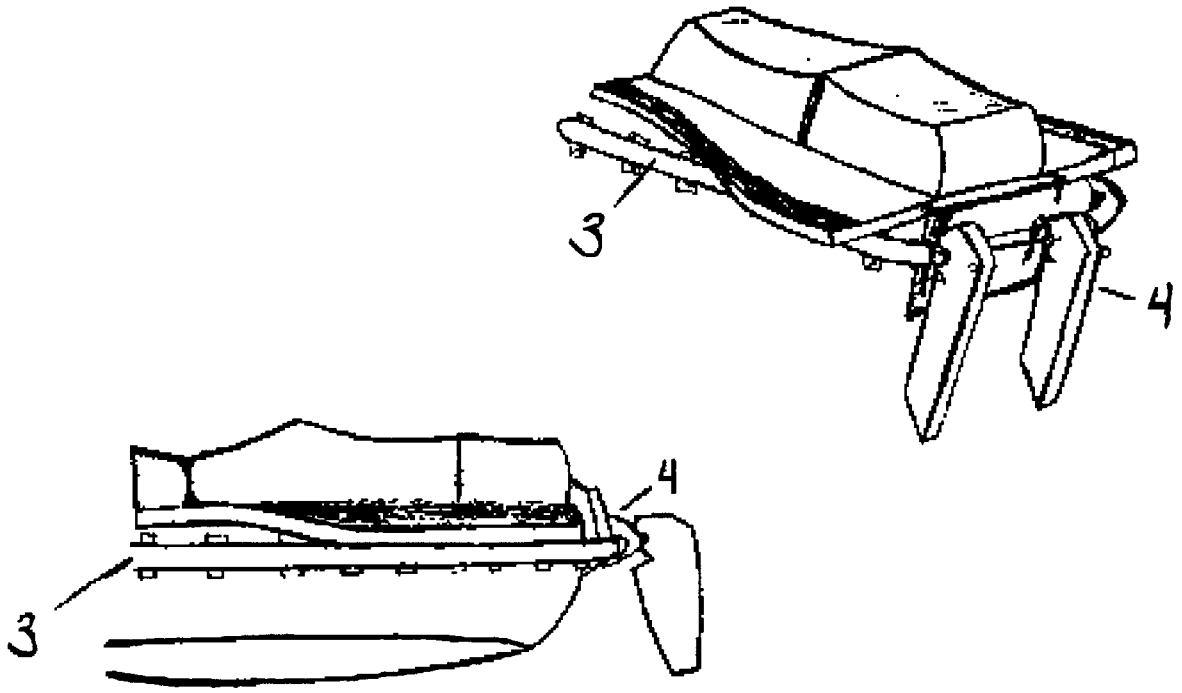
FIG. 4 is a partial view of the pulley steer steering system utilizing a rudder system as a directional device.

The directional device 4 FIG. 1, FIG. 3 & FIG. 4 will respond to guidance provided by rope and work in conjunction with the rope, hose and steering mechanism 6 FIG. 2 in determining the direction in which the Jump-A-Wake will travel. The directional device may be designed in various forms and ways, yet, will always serve the function of determining the direction in which the watercraft will travel. The directional device may be made in the form of a rudder system 4 FIG. 1 & FIG. 4. The rudder system 4 FIG. 1 & FIG. 4 may be designed in various ways. The directional device may be made in the form of a mini ski system 4 FIG. 3. The mini ski system may be designed in various ways. The directional device 4 can be constructed in many ways, utilizing the combination of a wide assortment of materials. The rudder system version of the directional device 4 FIG. 1 & FIG. 4 is made of a combination of plastic (or the like) & metal (or the like) materials. The mini ski system may be made of a combination of plastic (or the like), metal (or the like), wood (or the like), or fiberglass (or the like) types of materials. In each design of the directional device the directional device will contain a rope receptor so that when the operator pulls on the steering mechanism 6 the rope 2 and hose 3 will assist the directional device in safely and effectively guiding the watercraft.

The steering mechanism 6 FIG. 2 may be designed to be made in many different shapes and sizes. The steering mechanism 6 will be made of pliable and durable materials. The steering mechanism will be joined to the rope 2. The steering mechanism will provide the operator of the Jump-A-Wake with something to hold on to as he/she operates the watercraft. By pulling on or turning the steering mechanism in one direction or the other, the operator will be able to steer his/her watercraft. The steering mechanism may connect with the watercraft via a mount 7 FIG. 2. The mount 7 will hold the steering mechanism 6 in place. The mount will attach to itself from both the inside and outside of the watercraft (as will mounts used for connecting directional devices to watercraft).

What is claimed is:

1. An apparatus for water recreation which is towable behind a motorized watercraft, comprising:

A towable inflatable watercraft used to carry one or more persons in/on the water, said inflatable watercraft including at least one towing rope receptor affixed thereto for attachment of a tow rope, said towable inflatable watercraft including a steering system, said steering system comprising a steering apparatus for receiving steering inputs from an operator, a directional device for receiving said inputs and imparting directional changes to said inflatable watercraft, and one or more lengths of rope extending thereinbetween, each said length of rope being received within a length of hose affixed to an exterior surface of said inflatable watercraft, whereby said outer surface of said inflatable watercraft is protected from damage due to movement of each length of rope in response to said steering inputs.

* * * * *